US010255777B1

(12) United States Patent
Soto et al.

(10) Patent No.: US 10,255,777 B1
(45) Date of Patent: Apr. 9, 2019

(54) SYSTEMS AND METHODS FOR DYNAMIC FIELD REDUCTION BASED ON A MEASURED DISTANCE BETWEEN A TAG AND A TAG DEACTIVATOR

(71) Applicants: Manuel Soto, Lake Worth, FL (US); Hubert A. Patterson, Boca Raton, FL (US); Adam S. Bergman, Boca Raton, FL (US)

(72) Inventors: Manuel Soto, Lake Worth, FL (US); Hubert A. Patterson, Boca Raton, FL (US); Adam S. Bergman, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 15/885,062

(22) Filed: Jan. 31, 2018

(51) Int. Cl.
*G08B 13/24* (2006.01)

(52) U.S. Cl.
CPC ..... *G08B 13/2411* (2013.01); *G08B 13/242* (2013.01); *G08B 13/2462* (2013.01); *G08B 13/2465* (2013.01)

(58) Field of Classification Search
CPC ..... G08B 13/2411; G08B 13/242; G08B 13/2465; G08B 13/2462
USPC ..... 340/572.3
See application file for complete search history.

(56) References Cited

U.S. PATENT DOCUMENTS

| | | | | |
|---|---|---|---|---|
| 5,801,371 | A * | 9/1998 | Kahn | G06K 7/10851 235/462.01 |
| 6,084,514 | A | 7/2000 | Kopp et al. | |
| 7,316,355 | B2 * | 1/2008 | Canipe | G08B 13/242 235/462.13 |
| 7,804,407 | B2 * | 9/2010 | Copeland | G08B 13/2431 340/572.1 |
| 7,830,255 | B2 | 11/2010 | Leone | |
| 8,264,348 | B2 * | 9/2012 | Dinh | G08B 13/248 340/572.4 |
| 9,024,762 | B2 | 5/2015 | Rasband et al. | |
| 9,311,796 | B2 * | 4/2016 | Bergman | G08B 13/2402 |
| 2011/0171910 | A1 * | 7/2011 | Dinh | G08B 13/2402 340/568.1 |

* cited by examiner

*Primary Examiner* — John A Tweel, Jr.
(74) *Attorney, Agent, or Firm* — Fox Rothschild LLP; Robert J. Sacco; Carol E. Thorstad-Forsyth

(57) ABSTRACT

Systems and methods for deactivating an Electronic Article Surveillance ("EAS") security tag coupled to an item. The methods comprise: detecting a presence of the EAS security tag in proximity to a tag deactivator; determining a distance between the item and at least one deactivation coil of the tag deactivator, in response to a detection of the EAS security tag; dynamically adjusting a deactivation field strength setting of the tag deactivator based on the distance that was previously determined; and using the at least one deactivation coil to generate a deactivation field in accordance with the deactivation field strength setting which was previously dynamically adjusted.

21 Claims, 3 Drawing Sheets

SYSTEMS AND METHODS FOR DYNAMIC FIELD REDUCTION BASED ON A MEASURED DISTANCE BETWEEN A TAG AND A TAG DEACTIVATOR

BACKGROUND

Statement of the Technical Field

The present disclosure relates generally to Electronic Article Surveillance ("EAS") systems. More particularly, the present disclosure relates to implementing systems and methods for dynamic field reduction based on a measured distance between a tag (or item to which the tag is coupled) and a tag deactivator.

Description of the Related Art

EAS detection systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS detection system utilizes disposable AcoustoMagnetic ("AM") markers to monitor items. The AM markers are generally attached to the packaging by adhesives or are disposed inside the packaging. The AM markers remain with the items when they are removed from the retail store.

The general operation of an AM EAS detection system is described in U.S. Pat. Nos. 4,510,489 and 4,510,490, the disclosure of which is herein incorporated by reference. The detection of markers in an AM EAS detection system by pedestals placed at an exit has always been specifically focused on detecting markers within the spacing of the pedestals. When an exciter signal is applied at a first pedestal it will generate an electro-magnetic field of sufficient intensity (or interrogation signal) so as to excite markers (or security tags) within the interrogation or detection zone. Similarly, a second pedestal will generally include an antenna having a main antenna field directed toward the detection zone (and toward the first pedestal). An exciter signal applied at the second pedestal will also generate an electromagnetic field with sufficient intensity (e.g., an interrogation signal) so as to excite markers (or security tags) within the interrogation or detection zone. When a marker tag is excited in the detection zone, it will generate an electromagnetic signal which can usually be detected by receiving the signal at the antennas associated with the first and second pedestal. In response to the reception of the electromagnetic signal, an alarm is issued.

The alarm issuance is not desirable when the item to which the AM marker or tag is coupled has been successfully purchased. Accordingly, Point Of Sale ("POS") systems include a tag deactivator embedded in a barcode scanner. During a purchase transaction, the barcode scanner scans a barcode affixed to the item, while the tag deactivator performs operations to detect a security tag in proximity thereto. Thereafter, a tag deactivation process is initialized.

The tag deactivation process involves: supplying power to a high-voltage capacitor; and using the capacitor to energize at least one coil whereby a magnetic field is generated of sufficient magnitude to render the security tag inactive. The inactive security tag is no longer responsive to the electromagnetic field emitted from the pedestal(s).

In some tag deactivation systems, a checkout clerk passes items one at a time over the tag deactivator, and then places the items in a shopping bag or cart. This system employs a first coil disposed horizontally within a housing and/or a second coil disposed vertically within the housing. The checkout clerk moves the tagged items across the horizontal top surface of the housing such that the tag is disposed generally coplanar with the first coil.

These tag deactivation systems suffer from certain drawbacks. For example, the deactivation height parameter is set to a fixed maximum value (e.g., 6-8 inches) which matches the maximum scanning distance. Setting the deactivation height parameter to such a fixed value means (1) the amount of power used by the tag deactivator to energize the coil(s) is always the same, (2) a maximum amount of power is employed for each tag deactivation, and (3) a highest magnetic field is generated for each tag deactivation.

SUMMARY

The present disclosure generally concerns implementing systems and methods for deactivating an EAS security tag coupled to an item. The methods comprise: detecting a presence of the EAS security tag in proximity to a tag deactivator; determining a distance between the item and at least one deactivation coil of the tag deactivator, in response to a detection of the EAS security tag; dynamically adjusting a deactivation field strength setting of the tag deactivator based on the distance that was previously determined; and using the at least one deactivation coil to generate a deactivation field in accordance with the deactivation field strength setting which was previously dynamically adjusted.

In some scenarios, a barcode is read before, after or simultaneously with the detecting. For example, if the tag deactivator is provided in a multi technology device having a barcode reader functionality and a tag detection/deactivation functionally. Such multi technology devices are typically placed at checkout counters or stations of retail stores. The present solution is not limited to the particulars of this example.

In those or other scenarios, the distance is determined using distance measurement data from a distance measurement device provided with the tag deactivator. Alternatively, or additionally, the distance is determined based on tag field strength information from the deactivation coil and/or field pattern null information from the deactivation coil. The deactivation coil can be located in a first plane that is horizontal to ground and/or located in a second plane that is vertical to ground.

In those or yet other scenarios, the deactivation field strength setting comprises a voltage setting for a capacitor connected to the at least one deactivation coil. The value for the voltage setting is computed based on the distance. More particularly, the value for the voltage setting is computed in accordance with the following Mathematical Equation $$V(z):=(\mathrm{AmpTurns}(z,w,l)\cdot \mathrm{Freq}(G,N)\cdot L(N))/(N\cdot eD)$$

where V(z) represents a voltage value to be applied to the capacitor when the item is at a distance z, AmpTurns(z,w,l) represents an Amp-turn peak product at a distance z (which is proportional to a field level as a function of coil size (w,l)), Freq(G,N) represents a resonant frequency as a function of wire gauge (G) and coil turns (N), L represents a coil inductance as a function of coil turns (N), N represents a number of coil turns, and eD represents an exponential decay factor of resonant discharge.

BRIEF DESCRIPTION OF THE DRAWINGS

The present solution will be described with reference to the following drawing figures, in which like numerals represent like items throughout the figures.

DETAILED DESCRIPTION

Figure 1:
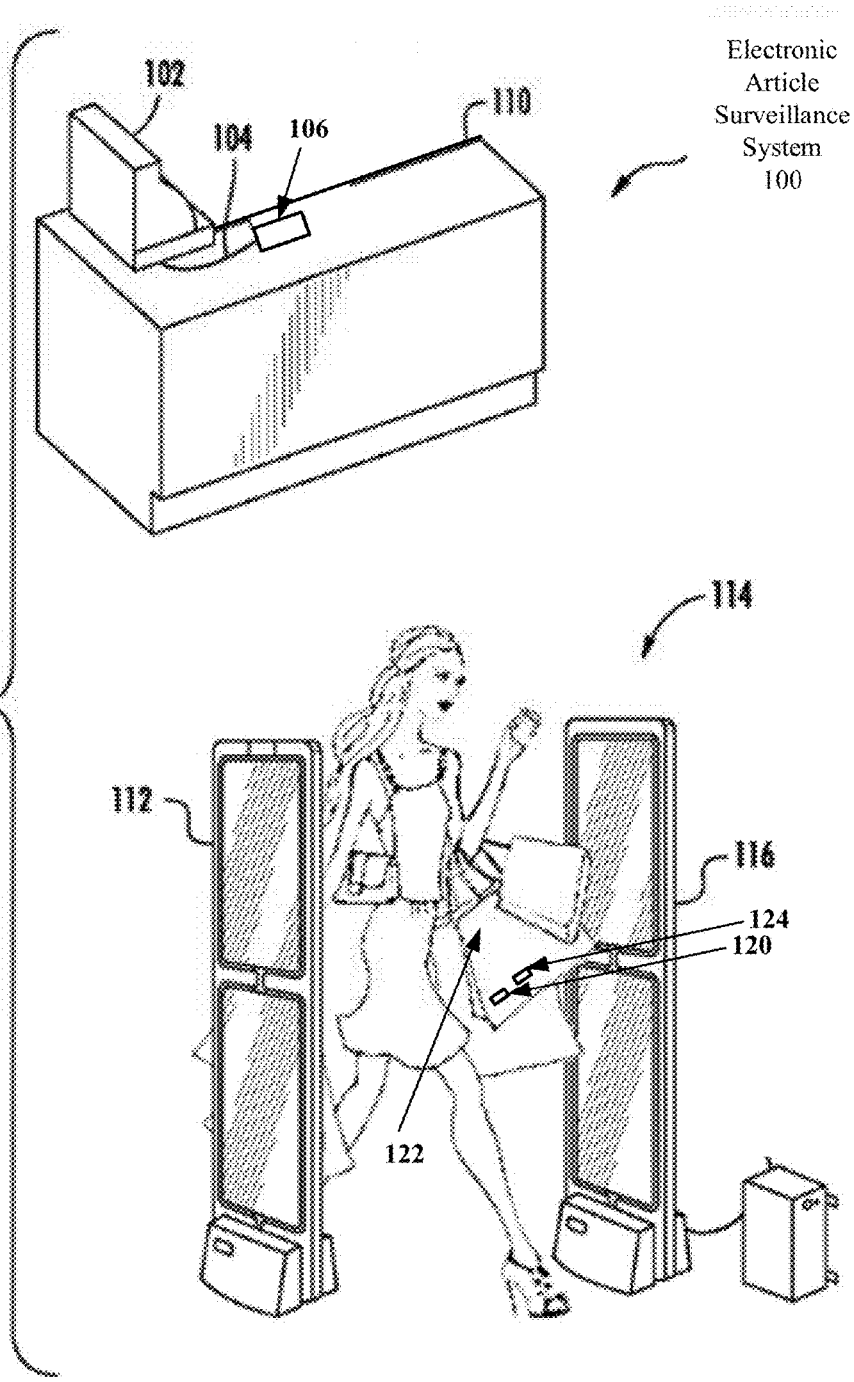
FIG. 1 is an illustration of an illustrative architecture for an EAS system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Deactivators for AM based EAS systems generate low frequency magnetic fields to demagnetize security tags, markers or labels. In the present document, the terms tag, marker and label are used interchangeably. The demagnetization fields use a large amount of instantaneous energy and create magnetic fields higher than are required in most situations. The present solution dynamically reduces the generated magnetic field strength to levels lower than that used today. As a result, human exposure to higher deactivation fields is reduced since the maximum deactivation filed is only generated when the user's hands are relatively far from the tag deactivator (thus limiting exposure), i.e., the reduction in the magnetic field correlates to a reduction in human exposure. The reduction in the generated magnetic field strength is achieved by: measuring the distance between an item and a reference location (e.g., a given surface (e.g., top surface) of a tag deactivator's housing); and adjusting the magnetic field strength based on the measured distance. The distance can be measured in a variety of ways. For example, a distance measuring device is employed to measure a distance from an item to the tag deactivator's coil(s). Alternatively or additionally, the position of the tag relative to the surface of the tag deactivator is determined using horizontally and/or vertically arranged detection coils. These coils detect the signal strength coming from the tag. The stronger the field, the closer the tag is to the tag deactivator surface and the deactivation field is reduced based on this received signal strength.

In some EAS detection systems, tag deactivators for AM tags are embedded in POS barcode scanners. The AM tags are deactivated as the respective items are passed over the POS barcode scanners. The deactivation height is set to a fixed value which typically results in 6-8 inches, which matches a maximum scanning distance. Setting the deactivation height to a fixed value means the amount of power used by the tag deactivator is always the same, which uses a maximum amount of energy and generates the highest fields for each deactivation.

By measuring the height the item is above the barcode scanner, the magnetic field can be reduced and the amount of energy reduced. Since the magnetic field level falls off as the cube of distance, even a small distance reduction can result in a significant reduction in the magnetic field level.

Distance can be measured by ultrasonic time of flight measurements or by laser measuring devices. Both types of measurements are very practical today because of their use in consumer devices. For instance, laser devices are used in golf to measure the distance from the ball to the tee. Some cell phones use ultrasonic technology to measure the distance from the head to the phone. These consumer uses drive the cost down and availability up. In addition, the electronics for these measuring devices is small and easily fits into existing barcode scanners and tag deactivation electronics.

Additionally or alternatively, existing detection system hardware and a new algorithm can be used to determine the location of the tag. Using field strength, antenna field patterns and null information from the horizontal and vertical detection elements as the marker traverses the barcode scanner area, the location of the tag can be determined. The advantage to this method is that it does not require any additional hardware to be installed.

In operation, the distance sensor measures the distance from any item to the scanner surface. The value of the measurement reduces the magnetic field generated depending on the height measured. The magnetic field is calculated to deactivate the tag at a height about N (e.g., 2) inches further than the measured distance. This is to guarantee that the deactivation field is strong enough to deactivate any tag coupled to the item. Current tagging protocol requires the tag to be placed within 2 inches of the barcode, which guarantees the tag is always near the deactivation coils no matter how large the item may be.

As an incidental benefit, the deactivation field to which hands are exposed is also reduced.

Referring now to FIG. 1, there is provided an illustration of an illustrative EAS system 100 that is useful for understanding the present solution. EAS systems are well known in the art, and therefore will not be described in detail herein. Still, it should be understood that the present solution will be described herein in relation to an AM (or magnetostrictive) EAS system. The EAS system 100 generally prevents the unauthorized removal of articles from a retail store.

In this regard, EAS security tags 120 are securely coupled to articles (e.g., purses, clothing, toys, and other merchandise) offered for sale by the retail store. At the exits of the retail store, detection equipment 114 sounds an alarm or otherwise alerts store employees when it senses an active EAS security tag 120 in proximity thereto. Such an alarm or alert provide notification to store employees of an attempt to remove an article from the retail store without proper authorization.

In some scenarios, the detection equipment 114 comprises antenna pedestals 112, 116. The antenna pedestals 112, 116 are configured to create a surveillance zone at the exit or checkout lane of the retail store by transmitting an EAS exciter signal. The EAS exciter signal causes an active EAS security tag 120 to produce a detectable response if an attempt is made to remove the article from the retail store.

For example, the EAS security tag 120 can cause perturbations in the EAS exciter signal. Each antenna pedestal 112, 116 is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in an EAS security tag within the surveillance zone. As a result of the stimulus signal, the EAS security tag 120 will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the surveillance zone. The same antenna contained in a pedestal 112, 116 can serve as both the transmit antenna and the receive antenna. Accordingly, the antennas in each of the pedestals 112, 116 can be used in several different modes to detect a security tag exciter signal.

The EAS security tag 120 can be deactivated using a Multi Technology System ("MTS") 106. The MTS 106 is shown in FIG. 1 as being located at a checkout counter 110 of a retail store and communicatively coupled to a POS terminal 102 via a wired link 104. In general, the POS terminal 102 facilitates the purchase of articles from the retail store. POS terminals are well known in the art, and therefore will not be described herein. Any known or to be known POS terminal can be used herein without limitation.

The MTS 106 comprises a barcode scanner and a tag deactivator. These components of the MTS 106 will be discussed in detail below in relation to FIG. 2. The EAS security tag 120 is deactivated by store employees during a purchase transaction. For example, the EAS security tag 120 is deactivated while the item 122 is passed over the MTS 106 for barcode scanning purposes. The barcode scanning facilitates the purchase transaction for the item 122. The present solution is not limited to the particulars of this example. For example, the EAS security tag 120 is alternatively deactivated when the corresponding item 122 has been successfully purchased or has been otherwise authorized for removal from the retail store.

In some cases, the MTS 106 is configured to operate as an RFID reader. As such, the MTS 106 may transmit an RFID interrogation signal for purposes of obtaining RFID data from a dual technology security tag (i.e., an EAS and RFID security tag). Upon receipt of the unique identifier, the MTS 106 communicates the unique identifier to the POS terminal 102. At the POS terminal 102, a determination is made as to whether the unique identifier is a valid unique identifier for an EAS security tag of the retail store. If it is determined that the unique identifier is a valid unique identifier for an EAS security tag of the retail store, then the POS terminal 102 notifies the MTS 106 that the unique identifier has been validated, and therefore the EAS security tag 120 can be deactivated.

Figure 2:
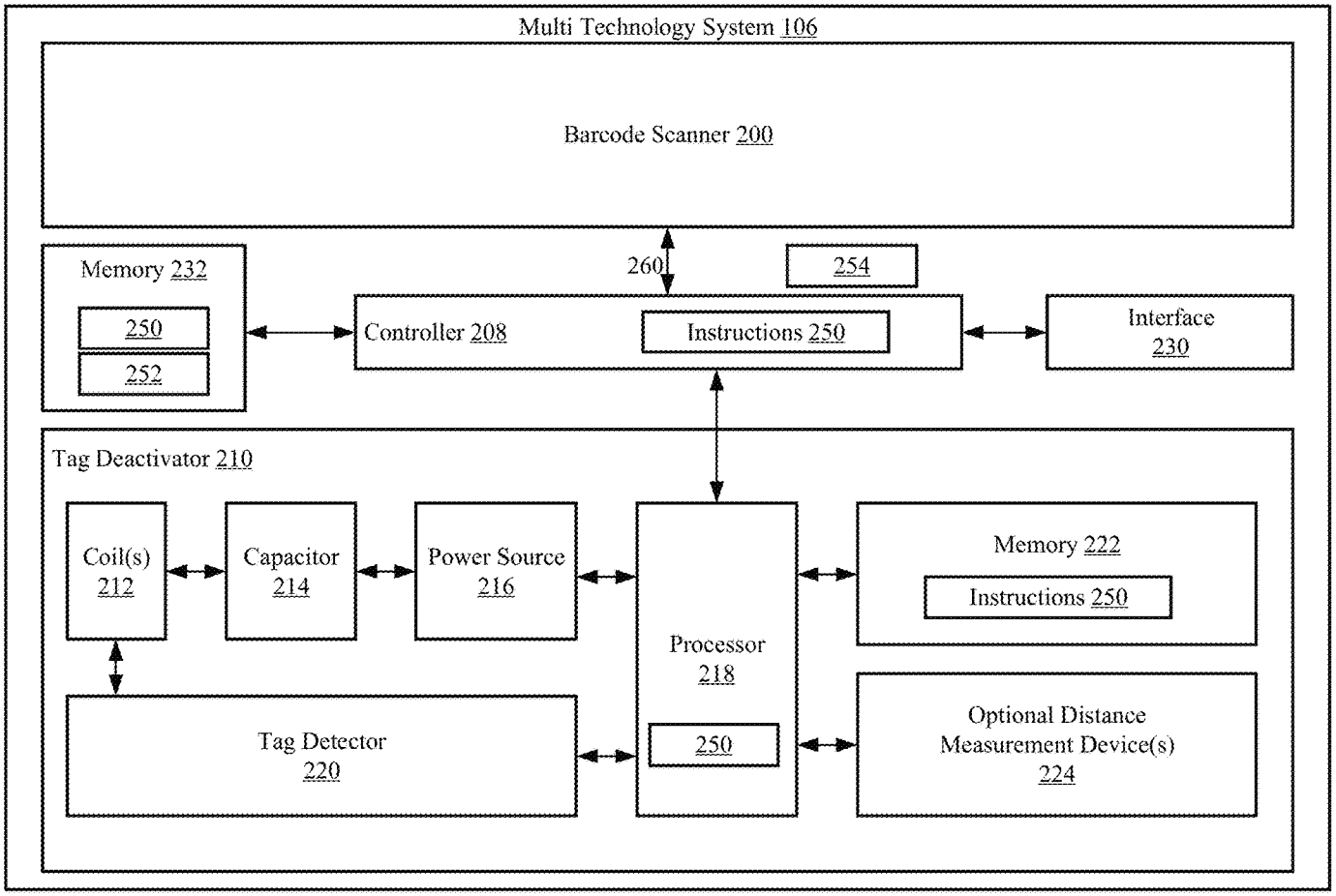
FIG. 2 is an illustration of an illustrative architecture for the barcode scanning system shown in FIG. 1.

Referring now to FIG. 2, there is provide an illustration of an illustrative architecture for the MTS 106. The MTS 106 comprises a barcode scanner 200. Barcode scanners are well known in the art, and therefore will not be described in detail herein. Any known or to be known barcode scanner can be used herein without limitation. For example, a laser or optical barcode scanner is employed here.

The barcode scanner 200 is generally configured to scan a barcode affixed to the corresponding item 122 and process the scanned barcode to extract information therefrom. The barcode scanner 200 may process the barcode in a manner defined by a barcode application 252 installed on the MTS 106. Additionally, the barcode scanning application can use camera 254 to capture the barcode image for processing. The barcode application 252 can include, but is not limited to, a COTS application. The barcode scanner 200 provides the extracted information to the controller 208. As such, the barcode scanner 200 is coupled to the controller 208 via an electrical connection 260. The controller 208 uses the extracted information in accordance with the function(s) of the MTS 106. For example, the extracted information can be used by MTS 106 to enable tag deactivation functionalities thereof.

The MTS 106 also comprises a tag deactivator 210. The tag deactivator 210 comprises at least one coil 212, a capacitor 214, a power source 216, a processor 218, a tag detector 220, a memory 222, and an optional distance measurement device 224. The coil(s) 212 are provided to facilitate tag detection and tag deactivation. For tag deactivation, the coil(s) 212 is(are) energized to generate a magnetic field of sufficient magnitude to render the EAS security tag 120 inactive. The deactivated EAS security tag 120 no longer responds to the incident energy of the EAS system 100 so that an alarm is not triggered when the item 120 leaves the retail store.

In some scenarios, the MTS 106 comprises (a) a single coil 212 located in a first plane that is horizontal to ground, or (b) an L-shaped coil 212 with a first portion located in the first plane and a second portion located in a second plane vertical to ground. In other scenarios, the MTS 106 comprises two coils 212 that are arranged so as to be perpendicular to each other, i.e., a first coil is located in the first plane that is horizontal to ground and a second coil is located in the second plane that is vertical to ground. In yet other scenarios, the MTS 106 comprises three coils 212, i.e., a first coil is located in the first plane that is horizontal to ground, a second coil is located in the second plane that is vertical to ground, and a third coil located in a third plane vertical to ground.

The power source 216 is configured to charge the capacitor 214. Current is supplied from the capacitor 214 to the coil(s) 212. At this time, a deactivation field is generated by the coil(s) 212. The strength of the deactivation field is dynamically varied based on measured distances between items and the MTS 106. In this way, the deactivation field strength is lower when the EAS security tag is closer to the deactivation coil(s) 212, and greater when the EAS security tag is farther from the deactivation coil(s) 212. The adjustment of the deactivation field strength is achieved by dynamically controlling the amount of voltage applied to the capacitor 214 so that the resulting deactivation field is sufficient to deactivate the EAS security tag while not necessarily being at its maximum strength.

The distance between items and the deactivation coil(s) 212 can be measured by a distance measurement device 224 local to the MTS 106. Distance measurement devices are well known in the art, and therefore will not be described herein. Any known or to be known distance measurement device can be used herein without limitation. For example, in some scenarios, a physical position sensor is employed to approximate where the item is relative to the deactivation coil. A separate physical position sensor can be provided to determine the distance of an item to a respective one of a plurality of deactivation coils. The orientation of the EAS security tag 120 is assumed based on knowledge that the tag is within a certain distance from the barcode 124. The distance and/or orientation of the EAS security tag 120 is(are) then stored in memory 222.

Alternatively or additionally, the distance between items and the deactivation coil(s) 212 can be measured using the deactivation coil(s) 212 to determine a field strength of the EAS security tag 106. An accurate tag's position is determined consistently based on the field strength from a deactivation coil having a horizontal orientation relative to ground. However, the tag's position is less accurate when determined based on the field strength from a deactivation coil in a vertical orientation relative to ground. In this case, a null exists in the field pattern. The field strength and null information from both deactivation coils as the tag traverses the MTS surface area are used to approximate the tag's position relative to the deactivation coils. The advantage of this technique is that no additional hardware is required to be added to conventional tag deactivators. The novelty of this technique is that a null in one coil orientation is used to help predict the tag's position relative to the deactivation coils.

Once the distance is determined, the deactivation field strength adjustment value is computed by processor 218. As noted above, the adjustment of the deactivation field strength is achieved by dynamically controlling the amount of voltage applied to the capacitor. Thus, the computation involves computing a voltage value based on the determined distance z of the EAS security tag from the coil(s) 122. The computation is defined by the following Mathematical Equation (1).

$$V(z):=(\text{AmpTurns}(z,w,l)\cdot\text{Freq}(G,N)\cdot L(N))/(N\cdot eD) \quad (1)$$

where V(z) represents a voltage value to be applied to capacitor 214 when the item is at a distance z, AmpTurns (z,w,l) represents an Amp-turn peak product at a distance z (which is proportional to a field level as a function of coil size (w,l)), Freq(G,N) represents a resonant frequency as a function of wire gauge (G) and coil turns (N), L represents a coil inductance as a function of coil turns (N), N represents a number of coil turns, and eD represents an exponential decay factor of resonant discharge.

A constant C may be added to the computed voltage value V(z) for purposes of increasing the probability or likelihood that the EAS security tag will be deactivated by the resultant deactivation field. This computation is defined by the following Mathematical Equation (2).

$$V(z)=V(z)+C \quad (2)$$

The value of constant C is selected so that the deactivation field strength is strong enough to deactivate an EAS security tag that is N (e.g., 2) inches further than the measured distance z. The present solution is not limited in this regard.

During a purchase transaction, information acquired by the barcode scanner 200 is forwarded to the POS terminal 102 via the controller 208. Controller 208 is communicatively coupled to the POS terminal 102 through an interface 230. Operations of the tag deactivator 210 are controlled by the POS terminal 102 via the controller 208. For example, the POS terminal 102 can cause an initiation of barcode scanning operations, an initiation of tag detection operations by tag detector 220, and/or an initiation of tag deactivation operations by tag deactivator 210 when certain criteria is met. Tag detectors are well known in the art, and therefore will not be described in detail herein. Any known or to be known tag detector can be used herein without limitation.

As shown in FIG. 2, one or more sets of instructions 250 are stored in memory 232 and/or memory 222. The instructions may include customizable instructions and non-customizable instructions. The instructions 250 can also reside, completely or at least partially, within the controller 208 and/or processor 218 during execution thereof by MTS 106. In this regard, the memory 232, 222, the controller 208, and/or the processor 218 can constitute machine-readable media. The term "machine-readable media", as used herein, refers to a single medium or multiple media that stores one or more sets of instructions 250. The term "machine-readable media", as used here, also refers to any medium that is capable of storing, encoding or carrying the set of instructions 250 for execution by the MTS 106 and that causes the MTS 106 to perform one or more of the methodologies of the present disclosure.

Figure 3:
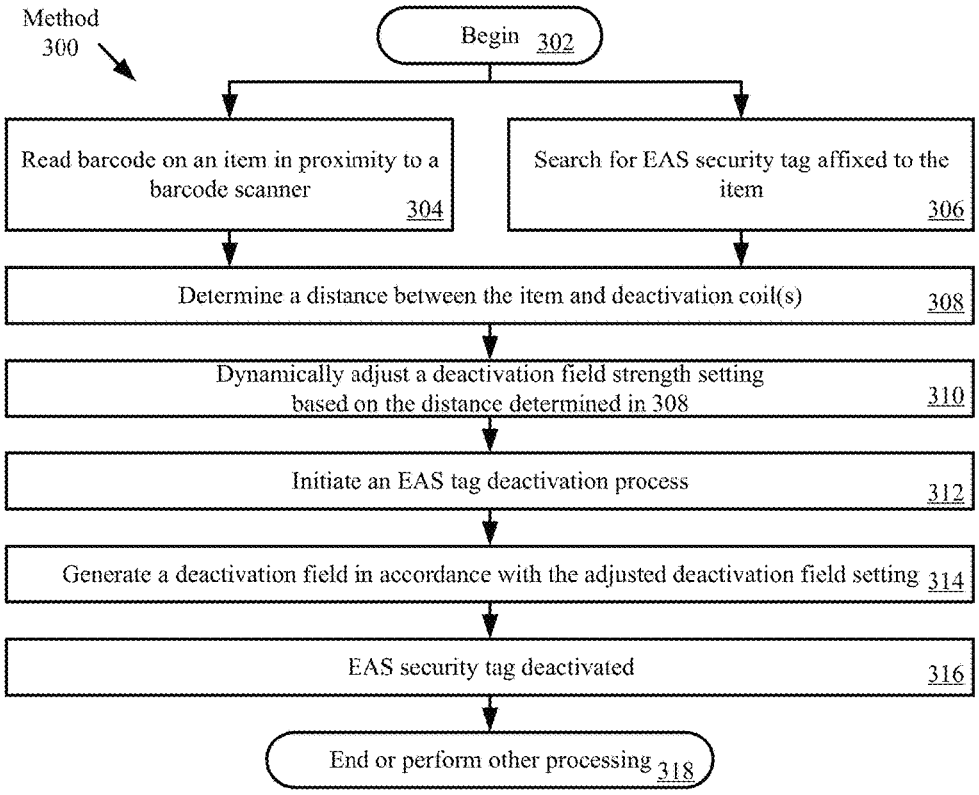
FIG. 3 is a flow diagram of an illustrative method for deactivating a tag.

Referring now to FIG. 3, there is provided a flow diagram of an illustrative method 300 for deactivating an EAS tag, label or marker. Method 300 comprises a plurality of blocks 302-318. The present solution is not limited to the order of blocks 302-318 shown in FIG. 3. The operations of blocks 302-318 can be performed in a different order (than that shown) in accordance with a given application. For example, the operations of block 306 can occur prior to or subsequent to the operations of block 304, rather than concurrent with the operations of block 304 as shown in FIG. 3.

Method 300 begins with 302 and continues with 304-306. 304 involves reading a barcode (e.g., barcode 124 of FIG. 1) on an item (e.g., item 122 of FIG. 1) in proximity to a barcode scanner (e.g., barcode scanner 200 of the MTS 106 shown in FIGS. 1-2). 306 involves searching for an EAS security tag (e.g., EAS security tag 120 of FIG. 1) affixed to the item. This searching is performed to detect the presence of the EAS security tag in proximity to a tag deactivator (e.g., tag deactivator 210 of FIG. 2). Methods for searching for EAS security tags are well known in the art, and therefore will not be described in detail herein. Any known or to be known methods for searching for an EAS security tag can be used herein without limitation. For example, in some scenarios, a processor (e.g., processor 218 of FIG. 2) applies an exciter signal to a tag detector (e.g., tag detector 220 of FIG. 2). When this occurs, the tag detector generates an electro-magnetic field of sufficient intensity (or interrogation signal) so as to excite the EAS security tag within a detection zone. When the EAS security tag is excited in the detection zone, it will generate an electromagnetic signal which is detected by receiving the signal at the tag detector. In response to the reception of the electromagnetic signal, a tag detection is made.

Next in 308, operations are performed by a tag deactivator (e.g., tag deactivator 210 of FIG. 2) to determine a distance between the item and at least one deactivation coil (e.g., coil 212 of FIG. 2). Operations of 308 are performed in response to the detection of the EAS security tag in 306. Thus, if no detection is made in 306, then the operations of 308-316 may not be performed. In some scenarios, the distance is determined in 308 by a distance measurement device (e.g., distance measurement device 224 of FIG. 2). In other scenarios, the distance is additionally or alternatively measured based on a field strength of the EAS security tag determined using one or more deactivation coils (e.g., coils 212 of FIG. 2).

Once the distance is determined, a deactivation field strength setting is dynamically adjusted based thereon as shown by 310. In some scenarios, the deactivation field strength setting comprises a voltage value specifying an amount of voltage to be applied to a capacitor (e.g., capacitor 214 of FIG. 2) connected to the deactivation coil(s). The voltage value is computed in accordance with the above provided Mathematical Equations (1) and/or (2).

Next in 312, an EAS tag deactivation process is initiated. Once initiated, a deactivation field is generated in accordance with the adjusted deactivation field setting, as shown by 314. The deactivation field caused the EAS security tag to be deactivated in 316. Subsequently, 318 is performed where method 300 ends or other processing is performed.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for deactivating an EAS security tag coupled to an item, comprising:

detecting a presence of the EAS security tag in proximity to a tag deactivator;

determining a distance between the item and at least one deactivation coil of the tag deactivator, in response to a detection of the EAS security tag;

dynamically adjusting a deactivation field strength setting of the tag deactivator based on the distance that was previously determined; and using the at least one deactivation coil to generate a deactivation field in accordance with the deactivation field strength setting which was previously dynamically adjusted.

2. The method according to claim 1, further comprising reading a barcode coupled to the item before, after or simultaneously with the detecting.

3. The method according to claim 1, wherein the distance is determined using distance measurement data from a distance measurement device provided with the tag deactivator.

4. The method according to claim 1, wherein the distance is determined based on tag field strength information from the at least one deactivation coil.

5. The method according to claim 4, wherein the distance is further determined using field pattern null information from the at least one deactivation coil.

6. The method according to claim 1, wherein the at least one deactivation coil is located in a first plane that is horizontal to ground or is located in a second plane that is vertical to ground.

7. The method according to claim 1, wherein the at least one deactivation coil comprises a first coil located in a first plane that is horizontal to ground and a second coil located in a second plane that is vertical to ground.

8. The method according to claim 1, wherein the at least one deactivation coil comprises a first portion located in a first plane that is horizontal to ground and a second portion located in a second plane that is vertical to ground.

9. The method according to claim 1, wherein the deactivation field strength setting comprises a voltage setting for a capacitor connected to the at least one deactivation coil.

10. The method according to claim 9, wherein a value for the voltage setting is computed based on the distance.

11. The method according to claim 10, wherein the value for the voltage setting is computed in accordance with the following Mathematical Equation $$V(z):=(\mathrm{AmpTurns}(z,w,l)\cdot\mathrm{Freq}(G,N)\cdot L(N))/(N\cdot eD)$$

where V(z) represents a voltage value to be applied to the capacitor when the item is at a distance z, AmpTurns(z,w,l) represents an Amp-turn peak product at a distance z (which is proportional to a field level as a function of coil size (w,l)), Freq(G,N) represents a resonant frequency as a function of wire gauge (G) and coil turns (N), L represents a coil inductance as a function of coil turns (N), N represents a number of coil turns, and eD represents an exponential decay factor of resonant discharge.

12. A system, comprising:

a tag detector configured to detect a presence of an Electronic Article Surveillance ("EAS") security tag in proximity thereto; and a tag deactivator comprising a processor; and a non-transitory computer-readable storage medium comprising programming instructions that are configured to cause the processor to implement a method for deactivating the EAS security tag, wherein the programming instructions comprise instructions to:

determine a distance between an item to which the EAS security tag is coupled and at least one deactivation coil of the tag deactivator, in response to the tag detector's detection of the EAS security tag;

dynamically adjust a deactivation field strength setting based on the distance that was previously determined; and at least one deactivation coil to generate a deactivation field in accordance with the deactivation field strength setting which was previously dynamically adjusted.

13. The system according to claim 12, further comprising a barcode reader configured to read a barcode coupled to the item before, after or simultaneously with the EAS security tag's detection.

14. The system according to claim 12, wherein the distance is determined using distance measurement data from a distance measurement device provided with the tag deactivator.

15. The system according to claim 12, wherein the distance is determined based on tag field strength information from the at least one deactivation coil.

16. The system according to claim 15, wherein the distance is further determined using field pattern null information from the at least one deactivation coil.

17. The system according to claim 12, wherein the at least one deactivation coil is located in a first plane that is horizontal to ground or is located in a second plane that is vertical to ground.

18. The system according to claim 12, wherein the at least one deactivation coil comprises a first coil located in a first plane that is horizontal to ground and a second coil located in a second plane that is vertical to ground.

19. The system according to claim 12, wherein the deactivation field strength setting comprises a voltage setting for a capacitor connected to the at least one deactivation coil.

20. The system according to claim 19, wherein a value for the voltage setting is computed based on the distance.

21. The system according to claim 20, wherein the value for the voltage setting is computed in accordance with the following Mathematical Equation $$V(z):=(\mathrm{AmpTurns}(z,w,l)\cdot \mathrm{Freq}(G,N)\cdot L(N))/(N\cdot eD)$$

where V(z) represents a voltage value to be applied to the capacitor when the item is at a distance z, AmpTurns(z,w,l) represents an Amp-turn peak product at a distance z (which is proportional to a field level as a function of coil size (w,l)), Freq(G,N) represents a resonant frequency as a function of wire gauge (G) and coil turns (N), L represents a coil inductance as a function of coil turns (N), N represents a number of coil turns, and eD represents an exponential decay factor of resonant discharge.

* * * * *